US008626356B2

(12) United States Patent
Davis et al.

(10) Patent No.: US 8,626,356 B2
(45) Date of Patent: Jan. 7, 2014

(54) REMOTELY STARTING INTERNAL COMBUSTION VEHICLE ENGINES SAFELY WITHIN VEHICLE ENCLOSURES

(75) Inventors: Michelle Davis, Austin, TX (US); Mark E Maresh, Austin, TX (US); Eric A Stegner, Austin, TX (US); Robert W Stegner, Austin, TX (US)

(73) Assignee: International Business Machines Corporation, Armonk, NY (US)

( * ) Notice: Subject to any disclaimer, the term of this patent is extended or adjusted under 35 U.S.C. 154(b) by 96 days.

(21) Appl. No.: 13/359,713

(22) Filed: Jan. 27, 2012

(65) Prior Publication Data

US 2013/0197716 A1 Aug. 1, 2013

(51) Int. Cl.
*F02D 41/06* (2006.01)
*F02N 11/08* (2006.01)

(52) U.S. Cl.
USPC ..... 701/2; 123/179.2; 123/179.4; 123/491

(58) Field of Classification Search
None
See application file for complete search history.

(56) References Cited

U.S. PATENT DOCUMENTS

| | | | | |
|---|---|---|---|---|
| 7,474,943 | B2 * | 1/2009 | Matsubara et al. | 701/2 |
| 7,634,333 | B2 | 12/2009 | Matsubara et al. | |
| 7,650,864 | B2 | 1/2010 | Hassan et al. | |
| 2006/0068973 | A1 * | 3/2006 | Kappauf et al. | 477/107 |
| 2010/0171588 | A1 * | 7/2010 | Chutorash et al. | 340/5.71 |
| 2011/0030639 | A1 | 2/2011 | Kwiecinski et al. | |
| 2011/0032115 | A1 | 2/2011 | Kwiecinski et al. | |

* cited by examiner

*Primary Examiner* — James Trammell
*Assistant Examiner* — Demetra Smith-Stewart
(74) *Attorney, Agent, or Firm* — J. B. Kraft; Steven L. Bennett

(57) ABSTRACT

Enabling the remote engine starter user to address accidental start obstacles resulting from specific vehicle enclosure structures. Remotely starting an internal combustion engine with onboard computer control of a vehicle enclosed within a confined enclosure that comprises determining a set of safe distances for each of the front, rear and top of the vehicle, respectively, from the front, rear and top of the enclosure. Then, it is sensed whether all of the distances of the front, rear and top of the vehicle from the enclosure are respectively further than each of the set of safe distances. The remote starting of the engine of the vehicle is enabled only if at least one of the distances is further than it's safe distance.

17 Claims, 4 Drawing Sheets

REMOTELY STARTING INTERNAL COMBUSTION VEHICLE ENGINES SAFELY WITHIN VEHICLE ENCLOSURES

TECHNICAL FIELD

The present invention relates to implementations for remotely starting internal combustion engines in vehicles such as automobiles and particularly to safety with respect to toxic carbon monoxide exhaust fumes that may accumulate when such remote vehicle may be in enclosed housing, i.e. a garage.

BACKGROUND OF RELATED ART

Remote vehicle engine starting technology has been used since about 1980. It has been particularly valuable where extreme conditions of heat or cold make it advantageous for operators to warm up their automobiles on cold days before leaving their offices or homes. The remote starter will also turn the heating system on cold winter days and turn air conditioners on when it is hot. Remote starters operate by transmitting a short range radio signal from a transmitter to a receiver in the vehicle engine starting system controlled by an onboard computer system in the vehicle. With many newer automobile models, the transmitter is in the "remote" key fob that may be used to remotely open doors and activate theft alarms. The radio signal may also be activated through home or office control consoles or initiated through cellular telephone technology.

A concern associated with remote vehicle engine starting is that the vehicle with the engine being remotely started will frequently be out of sight to the user. This could result in inadvertent and accidental starts that a user would be unaware of. Since vehicles are often housed in limited enclosures such as garages, there could be buildup of deadly carbon monoxide exhaust fumes. Since office, home, school or hospital space may often abut car parking enclosures, there is a danger to people in such facilities. At times, there may be children or animals in garages who may not recognize the danger of a running vehicle engine. This problem has been generally recognized. There is technology associated with remote engine starting that ensures that a garage door is open before an engine can be started remotely.

SUMMARY OF THE PRESENT INVENTION

The present invention goes beyond garage door open/close remote engine start technology to provide a more extensive implementation addressing exhaust fume concerns in remote vehicle engine starting. The present invention enables the user of the remote engine starter to address accidental start obstacles resulting from specific vehicle structures.

To this end, the present invention provides an implementation for remotely starting an internal combustion engine with onboard computer control of a vehicle enclosed within a confined enclosure that comprises determining a set of safe distances for each of the front, rear and top of the vehicle, respectively, from the front, rear and top of the enclosure. Then, it is sensed whether all of the distances of the front, rear and top of the vehicle from the enclosure are respectively further than each of the set of safe distances. The remote starting of the engine of the vehicle is enabled only at least one of the distances than it's safe distance. Optionally, the set of safe distances may further include safe distances from the two sides of the vehicle from the enclosure; in which case, the safe distances from the two sides of the vehicle to the enclosure are also sensed.

In accordance, with an aspect of the invention, the set of safe distances is determined by initially sensing the distances of the front, rear and top of the vehicle from an enclosure and adding a predetermined safety distance factor to each of the sensed distances. This safety factor may be added automatically.

As will be hereinafter described in greater detail, a user may be enabled to interactively enter data into a display for the onboard computer to override said safe distances.

BRIEF DESCRIPTION OF THE DRAWINGS

The present invention will be better understood and its numerous objects and advantages will become more apparent to those skilled in the art by reference to the following drawings, in conjunction with the accompanying specification, in which.

DETAILED DESCRIPTION OF THE PREFERRED EMBODIMENT

Figure 2A:
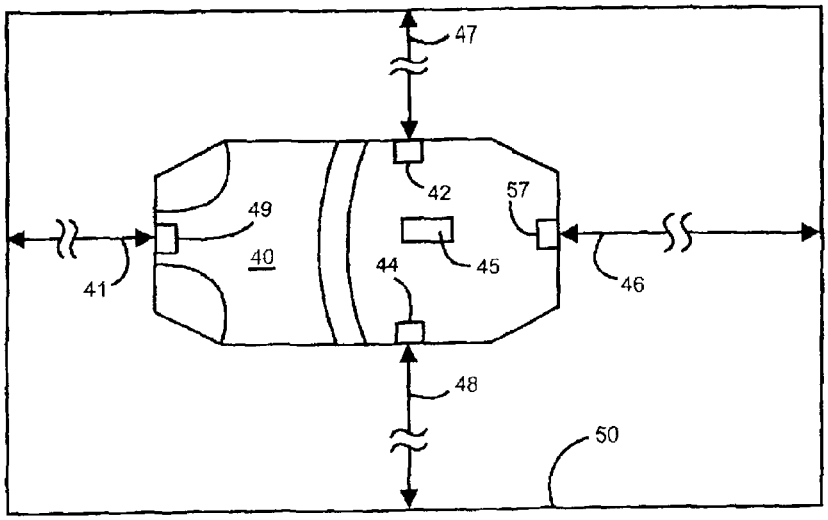
FIG. 2A is an illustrative plan view of a vehicle within an enclosure showing the sensors and the distances being sensed.
Figure 2B:
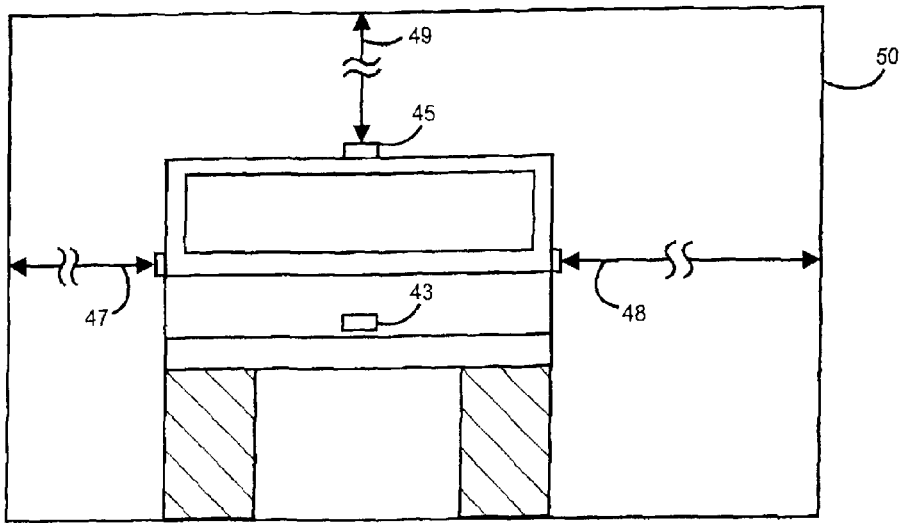
FIG. 2B is a front view of the vehicle and enclosure of FIG. 2A.
Figure 4:
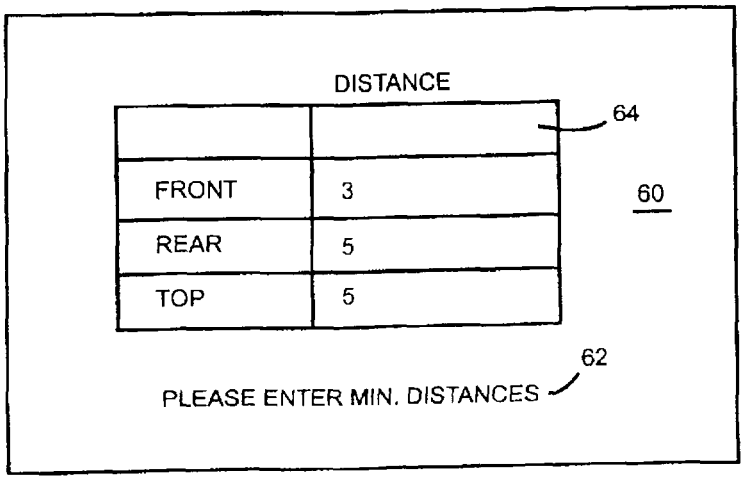
FIG. 4 is a generalized diagrammatic view of the display screen of an onboard computer showing a dialog table for prompting a user to enter determined safe distances to the enclosure.

Referring to FIG. 2A, there is shown an illustrative plan view of a vehicle within an enclosure showing the sensors and the distances being sensed. FIG. 2B is a front view of the vehicle and enclosure of FIG. 2A. Automobile 40 is within enclosure 50. Sensors 43 and 57 respectively sense distances 41 and 46 from the front and rear of the enclosure. Sensor 45 senses distance 49 from the top of the enclosure. Optionally, sensors 42 and 44 respectively sense distances 47 and 48 from the two sides of the enclosure. As will be described with respect to FIGS. 4 and 5, the data sensed may be used in several ways to make remote engine starting safer. FIG. 4 is a generalized diagrammatic view of the display screen of an onboard computer showing a dialog table that prompts a user to enter the distances that the user determines to be safe distances to the enclosure. In this display 60, the operator of the automobile is prompted 63 to enter what the operator has determined to be safe distances 64. With this arrangement, the sensor will check the distances whenever the automobile is parked within an enclosure and the operator commences a remote start signal. The automobile will start only if at least one sensed distances from the front, rear and top of the enclosure exceeds its safe distances.

Figure 5:
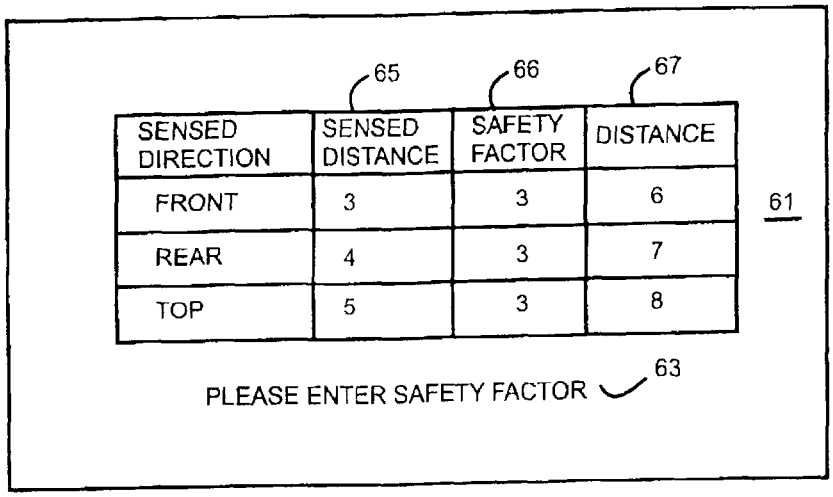
FIG. 5 is a generalized diagrammatic view of the display screen of an onboard computer showing a dialog table for prompting a user to enter safety factors to sensed distances so as to determine safe distances to the enclosure.

Referring now to FIG. 5, there is shown a generalized diagrammatic view of the display screen of an onboard computer showing a dialog table for prompting 63 a user to enter safety factors to sensed distances so as to determine safe distances to the enclosure. Thus, safety factors 66 are respectively added automatically to the sensed distances 65 to determine the distances 67 that are safe distances. With this arrangement, the sensor will check the distances from the enclosure whenever the automobile is parked within an enclosure and the operator commences a remote start signal. The automobile will start only if one of the sensed distances from the front, rear and top of the enclosure exceeds it's safe distance 67.

It should be noted that the distances from an enclosure, as described in FIGS. 2A and 2B, may also include distances from the sides of the vehicle to the enclosure. When such distances from the sides of the enclosure are also included, the distances dealt with in FIGS. 4 and 5 will include such distances to the sides of the enclosure. The enclosure described may be an ordinary one or two car garage, an enclosed large commercial parking facility or even a pole barn.

Figure 1:
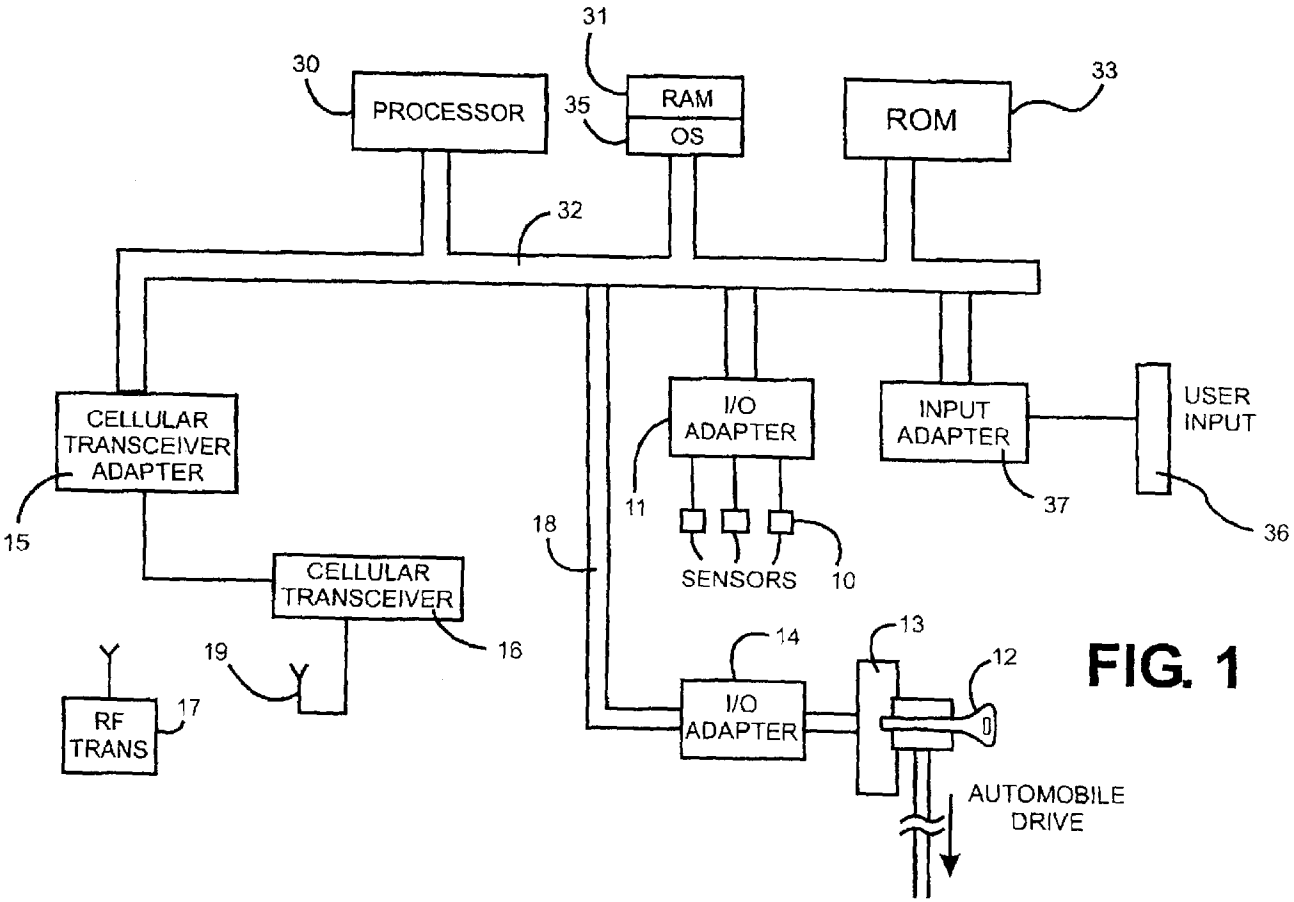
FIG. 1 is a simplified illustrative diagrammatic view of an onboard computer system that may be used to implement the present invention.

Referring to FIG. 1, there is provided a diagrammatic view of a typical computer control system that may function as an automobile onboard controller for various automotive functions, including the vehicle operational functions, as well as the apparatus, in accordance with the present invention for carrying out the sensing of distances from enclosures and controlling the remote starting of automobiles through wireless radio signals as previously described with respect to FIGS. 2A, 2B, 4 and 5.

The distance sensors 10 are positioned at the front, rear, top and sides of the automobile and connected via input/output (I/O) adapter 11 to a central processing unit 30, which in turn is interconnected to various other components by system bus 32.

An operating system (OS) 35 that runs on processor 30 provides control and is used to coordinate the functions of the various components of the control system. The OS 35 is stored in Random Access Memory (RAM) 31. The programs for controlling the various functions of the automobile, including the sensing and controlling of the remote starting safety functions of the present invention, are permanently stored in Read Only Memory (ROM) 33 and moved into and out of RAM to perform their respective functions. The sensed distances, safety factors and safe distances are all stored in RAM 31.

The remote operator at the remote radio frequency (RF) transmitter 17 initiates the start signal to antenna 19 for the automobile onboard transceiver 16. Transmitter 17 may be any handheld computer, display smart phone, personal digital assistant (PDA), iPad™ and almost any mobile communication display device enabled to be wireless through Wi-Fi (Wireless Fidelity) technology, i.e. IEEE 802.11 protocol technology. The short range transmissions from transceiver 17 can operate within areas of 10 to 100 meters from the automobile.

Accordingly, when the operator sends the remote start signal from RF transceiver 17, it is received at onboard transceiver 16 and conveyed through transceiver adapter 15 via bus 32 to processor 30 that transfers the remote engine safe start program of the present invention to RAM 31 that already has the safety factors, safe distances, of the present invention. The distances to the enclosure for the automobile sensed by sensors 10 are transmitted via I/O adapter 11 to RAM 31 wherein the programs of the present invention under the control of operating system 35 determine whether at least one of the distances from the enclosure is safe enough to start the automobile engine. If Yes, then processor 30 sends the start command via the standard linkage to the automobile drive set up, but via I/O adapter 14 through connection 18. The effect will be the same as if a key 12 were inserted into the ignition receiving element and the automotive drive will be started.

User input 36, which is the display for the onboard computer of FIG. 1, is connected via input adapter 37 to processor 30 and may be used for the previously described operator input of safety factors, safe distances and like information to the onboard computer.

Figure 3:
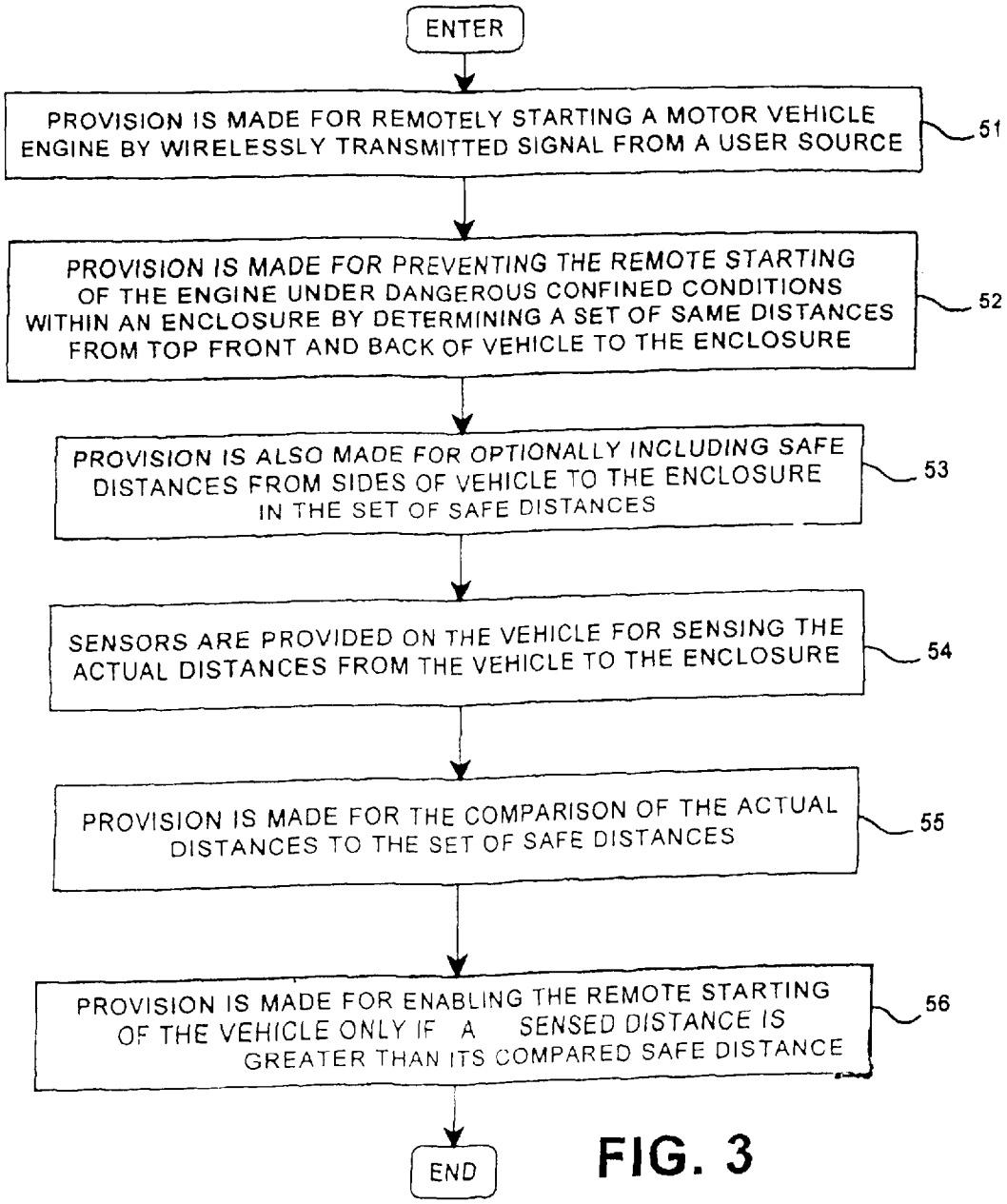
FIG. 3 is a general flowchart of a program set up to implement the present invention for remotely starting an internal combustion engine with onboard computer control of a vehicle enclosed within a confined enclosure.

Now, with reference to the programming shown in FIG. 3, there will be described how the system and programs of the present invention are set up. In a motor vehicle, having a standard onboard computer system that, among other functions, controls the remote starting of the motor vehicle, provision is made for the remote starting of the vehicle by a wireless transmitted signal, step 51. Provision is made for preventing the remote starting of the vehicle engine under dangerous confined conditions with an enclosure by determining a set of safe distances from the top, front and rear of the vehicle to the enclosure, step 52. Provision is made for optionally including safe distances from the sides of the vehicle to the enclosure to the set of safe distances, step 53. Sensors are provided for sensing the actual distances from the vehicle to the enclosure, step 54. Provision is made for the comparison of the actual distances to the set of safe distances, step 55, and provision is made for enabling the remote starting of the vehicle only if at least one sensed distance is greater than it's safe distance, step 56.

As will be appreciated by one skilled in the art, aspects of the present invention may be embodied as a system, method or computer program product. Accordingly, aspects of the present invention may take the form of an entirely hardware embodiment, an entirely software embodiment, including firmware, resident software, micro-code, etc.; or an embodiment combining software and hardware aspects that may all generally be referred to herein as a "circuit", "module" or "system." Furthermore, aspects of the present invention may take the form of a computer program product embodied in one or more computer readable mediums having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared or semiconductor system, apparatus or device, or any suitable combination of the foregoing. More specific examples (a non-exhaustive list) of the computer readable storage medium would include the following: an electrical connection having one or more wires, a portable computer diskette, a hard disk, a Random Access Memory ("RAM"), a Read Only Memory ("ROM"), an Erasable Programmable Read Only Memory ("EPROM" or Flash memory), an optical fiber, a portable compact disc read only memory ("CD-ROM"), an optical storage device, a magnetic storage device or any suitable combination of the foregoing. In the context of this document, a computer readable storage medium may be any tangible medium that can contain or store a program for use by or in connection with an instruction execution system, apparatus or device.

A computer readable medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate or transport a program for use by or in connection with an instruction execution system, apparatus or device.

Program code embodied on a computer readable medium may be transmitted using any appropriate medium, including, but not limited to, wireless, wire line, optical fiber cable, RF, etc., or any suitable combination the foregoing.

Computer program code for carrying out operations for aspects of the present invention may be written in any combination of one or more programming languages, including an object oriented programming language, such as Java, Smalltalk, C++ and the like, and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the later scenario, the remote computer may be connected to the user's computer through any type of network, including a local area network ("LAN") or a wide area network ("WAN"), or the connection may be made to an external computer (for example, through the Internet, using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer or other programmable data processing apparatus to produce a machine, such that instructions, which execute via the processor of the computer or other programmable data processing apparatus, create means for implementing the functions/acts specified flowchart and/or block diagram block or blocks.

These computer program instructions may also be stored in a computer readable medium that can direct a computer, other programmable data processing apparatus or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagram in the Figures illustrate the architecture, functionality and operations of possible implementations of systems, methods and computer program products according to various embodiments of the present invention. In this regard, each block in the flowchart or block diagrams may represent a module segment, or portion of code, which comprises one or more executable instructions for implementing the specified logical function(s). It should be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustrations can be implemented by special purpose hardware-based systems that perform the specified functions or acts, or combinations of special purpose hardware and computer instructions.

Although certain preferred embodiments have been shown and described, it will be understood that many changes and modifications may be made therein without departing from the scope and intent of the appended claims.

What is claimed is:

1. A method for remotely starting an internal combustion engine with onboard computer control of a vehicle enclosed within an confined enclosure comprising:

determining a set of safe distances for each of the front, rear, and top of the vehicle respectively from the front, rear, and top of the enclosure;

sensing whether all of the distances of the front, rear, and top of the vehicle from the enclosure are respectively farther than each of said set of safe distances including:

sensing the distances of the front, rear, and top of the vehicle, from an enclosure; and adding a predetermined safety distance factor to said sensed distances; and enabling remote starting of the engine of said vehicle when at least one of said distances are further than its safe distance.

2. The method of claim 1, wherein:

said set of safe distances further includes safe distances from the two sides of said vehicle from the enclosure; and said the safe distances from the two sides of the vehicle to the enclosure are also sensed.

3. The method of claim 1, wherein said adding of said safety distance factor is done automatically.

4. The method of claim 3, further including enabling a user to interactively enter data into a display for said onboard computer to override said safe distances.

5. The method of claim 1, wherein said sensing is ultrasonic sensing.

6. The method of claim 1, wherein said vehicle are remotely started by short range RF signals.

7. A system for remotely starting an internal combustion engine with onboard computer control of a vehicle enclosed within an confined enclosure comprising:

a processor;

a computer memory holding computer program instructions which when executed by the processor perform the method comprising:

determining a set of safe distances for each of the front, rear, and top of the vehicle respectively from the front, rear, and top of the enclosure;

sensing whether all of the distances of the front, rear, and top of the vehicle from the enclosure are respectively farther than each of said set of safe distances including:

sensing the distances of the front, rear, and top of the vehicle, from an enclosure; and adding a predetermined safety distance factor to said sensed distances; and enabling remote starting of the engine of said vehicle when at least one of said distances are further than its safe distance.

8. The system of claim 7, wherein:

said set of safe distances further includes safe distances from the two sides of said vehicle from the enclosure; and said the safe distances from the two sides of the vehicle to the enclosure are also sensed.

9. The system of claim 7, wherein said adding of said safety distance factor is done automatically.

10. The system of claim 9, wherein said performed method further includes enabling a user to interactively enter data into a display for said onboard computer to override said safe distances.

11. The system of claim 7, wherein said sensing is ultrasonic sensing.

12. The system of claim 7, wherein said vehicles are remotely started by short range RF signals.

13. A computer usable storage medium having stored thereon a computer readable program for remotely starting an internal combustion engine with onboard computer control of a vehicle enclosed within an confined enclosure, wherein the computer readable program when executed on a computer causes the computer to:

determine a set of safe distances for each of the front, rear, and top of the vehicle respectively from the front, rear, and top of the enclosure;

sense whether all of the distances of the front, rear, and top of the vehicle from the enclosure are respectively farther than each of said set of safe distances including:

sense the distances of the front, rear, and top of the vehicle, from an enclosure; and add a predetermined safety distance factor to said sensed distances; and enable remote starting of the engine of said vehicle when at least one of said distances are further than its safe distance.

14. The computer usable storage medium of claim 13, wherein:

said set of safe distances further includes safe distances from the two sides of said vehicle from the enclosure; and said the safe distances from the two sides of the vehicle to the enclosure are also sensed.

15. The computer usable storage medium of claim 13, wherein said computer program causes the computer to add said safety distance factor automatically.

16. The computer usable storage medium of claim 15, wherein the computer program further causes the computer to enable a user to interactively enter data into a display for said onboard computer to override said safe distances.

17. The computer usable storage medium of claim 13, wherein said sensing is ultrasonic sensing.

* * * * *